US011136725B2

(12) United States Patent
Klug et al.

(10) Patent No.: US 11,136,725 B2
(45) Date of Patent: Oct. 5, 2021

(54) DAMPING ARRANGEMENT FOR TRACKS

(71) Applicant: Daetwyler Sealing Technologies Deutschland GmbH, Waltershausen (DE)

(72) Inventors: Matthias Klug, Eisenach (DE); Bernd Pahl, Hamburg (DE)

(73) Assignee: Daetwyler Sealing Technologies Deutschland GmbH, Waltershausen (DE)

( * ) Notice: Subject to any disclaimer, the term of this patent is extended or adjusted under 35 U.S.C. 154(b) by 376 days.

(21) Appl. No.: 16/316,096

(22) PCT Filed: Jul. 11, 2017

(86) PCT No.: PCT/DE2017/200065
§ 371 (c)(1),
(2) Date: Jan. 8, 2019

(87) PCT Pub. No.: WO2018/010740
PCT Pub. Date: Jan. 18, 2018

(65) Prior Publication Data

US 2020/0208354 A1 Jul. 2, 2020

(30) Foreign Application Priority Data

Jul. 12, 2016 (DE) ..... 10 2016 112 720.5

(51) Int. Cl.
*E01B 5/10* (2006.01)
*E01B 19/00* (2006.01)

(52) U.S. Cl.
CPC ..... *E01B 5/10* (2013.01); *E01B 19/003* (2013.01)

(58) Field of Classification Search
CPC ..... E01B 5/04; E01B 5/10; E01B 9/38; E01B 15/00; E01B 19/00; E01B 19/003; E01B 21/00; E01B 2204/01
See application file for complete search history.

(56) References Cited

U.S. PATENT DOCUMENTS 4,606,498 A 8/1986 Grant et al.
5,464,152 A 11/1995 Wabnitz
(Continued)

FOREIGN PATENT DOCUMENTS

CN 103452016 A 12/2013
DE 8811396 U1 2/1990
(Continued)

OTHER PUBLICATIONS

International Search Report dated Oct. 20, 2017, in International Application No. PCT/DE2017/200065.
(Continued)

*Primary Examiner* — Robert J McCarry, Jr.
(74) *Attorney, Agent, or Firm* — Patent Central LLC; Stephan A. Pendorf

(57) ABSTRACT

A damping arrangement for tracks to be travelled over by rail vehicles having flanged wheels, including a) a rail, and b) an outer lateral profile of elastomer material which bears on the outer side of the rail at least in a region of a lateral outer rail head flank and in a region of an outer rail head underside, wherein the outer lateral profile has, in the region of the outer rail head underside and in the region of the lateral outer rail head flank, close to the rail, a soft region which is elastically resilient with respect to the rail head, and, in the region of the lateral outer rail head flank, remote from the rail, a substantially non-elastic hard region.

13 Claims, 7 Drawing Sheets

(56) References Cited

U.S. PATENT DOCUMENTS

| | | | | |
|---|---|---|---|---|
| 6,293,473 | B1 | 9/2001 | Ortwein et al. | |
| 7,556,209 | B2 * | 7/2009 | Sears | E01B 19/00 238/264 |
| 8,172,158 | B1 * | 5/2012 | Burkhardt | E01C 9/04 238/8 |
| 9,617,688 | B2 * | 4/2017 | Ellis | E01B 19/00 |
| 2003/0168519 | A1 | 9/2003 | Hofstetter | |
| 2005/0023366 | A1 * | 2/2005 | Williams | E01B 19/003 238/264 |
| 2007/0034705 | A1 * | 2/2007 | Gray, Jr. | E01B 21/00 238/8 |

FOREIGN PATENT DOCUMENTS

| | | | |
|---|---|---|---|
| DE | 4322468 | A1 | 1/1995 |
| DE | 19646133 | A1 | 5/1998 |
| DE | 19706936 | A1 | 8/1998 |
| DE | 19939838 | A1 | 2/2001 |
| EP | 0692572 | A1 | 1/1996 |
| EP | 1518963 | B1 | 7/2009 |
| WO | 9963160 | A1 | 12/1999 |
| WO | 0114642 | A1 | 3/2001 |
| WO | 0183889 | A1 | 11/2001 |
| WO | 2013087070 | A1 | 6/2013 |

OTHER PUBLICATIONS

International Preliminary Report on Patentability dated Jun. 6, 2018, in International Application No. PCT/DE2017/200065.

* cited by examiner

DAMPING ARRANGEMENT FOR TRACKS

The invention relates to a damping arrangement for tracks to be travelled on by rail vehicles with flanged wheels.

Damping arrangements for tracks with, for example, grooved and Vignole rails are basically known. Such arrangements usually comprise damping profiles that fit laterally against the rails. From WO 2001/014642 A1, for example, a damping profile is known, which, in the position of use, only partially fills the rail chambers and leaves them open on the side facing away from the rail web, and in which the region of the damping profile that can be attached or located directly on the lower face of the rail head is elastically compliant against the rail head. The damping profile provides both noise damping and also electrical insulation for the grooved rail. Damping arrangements are also known from EP 1518963 B1, DE 4322468 A1, EP 0692572 A1, U.S. Pat. No. 5,464,152 A, DE 19646133 A1, WO 2001/083889 A1 DE 197 06 936 A1, DE 8811396 U1, DE 19939838 A1, US 2003/0168519 A1, and U.S. Pat. No. 4,606,498 A.

In known damping arrangements, especially those in which the rails are embedded in concrete, asphalt, etc., such as tram rails, longitudinal rail encapsulation (SLV) is often used. This takes the form of an elastic mass that is cast into a joint provided along the sides of the rails. The SLV joint serves as a working joint between the moving rail and the rigid surrounding material, and prevents the wheel drum of the tram from running on the hard surrounding material. To create the SLV joint, after the rigid surrounding material (concrete, asphalt, etc.) has been applied, a joint is milled in an additional on-site operation to the width of the projecting wheel drum, and cast. This additional operation costs time and money. In addition, such SLV joints are maintenance-intensive and, for example, less resistant to the effects of adverse weather conditions or individual items of traffic (trucks, buses, etc.). The object of this invention is to enable a damping of rails that avoids the above disadvantages, and in particular requires less labour and maintenance.

In a first aspect, the object is achieved by a damping arrangement for tracks to be travelled on by rail vehicles with flanged wheels, comprising:

a. a rail with
   i. a rail head having an outer rail head lateral flank and an outer ail head lower face,
   ii. a rail web,
   iii. a rail foot; and
   iv. with an outer side facing away from the track interior; and b. an outer side profile of elastomeric material, which hears against the outer side of the rail, at least in the region of the outer rail head lateral flank, and in the region of the outer rail head lower face, wherein the outer side profile has, in the region of the outer rail head lower face and in the region of the outer rail head lateral flank, near to the rail, an elastically compliant soft region against the rail head, and in the region of the outer rail head lateral flank, remote from the rail, an essentially inelastic hard region.

The damping arrangement of the invention enables effective damping of tracks with, for example, Vignole or grooved rails, especially those that are embedded in a rigid substrate, such as concrete or asphalt. The damping arrangement provides for a side profile, i.e. a damping profile arranged on the side of the rail, which is designed such that it can take over the function of the longitudinal rail encapsulation, so that use of the latter can be dispensed with altogether. On the one hand, the damping profile absorbs the movements of the rail caused, for example, by the rail vehicle travelling on the rail, or by the individual items of traffic driving over the rail (cars, buses, trucks); on the other hand, it ensures that the wheel drum of the rail vehicle travelling on the rail, e.g. the tram, if dimensioned appropriately, does not run on the hard surrounding material, but on the upper edge of the side profile if the rail head is worn down accordingly. The width of the damping profile in the region of the outer rail head lateral flank, in particular in the hard region remote from the rail that is provided there, can be adapted accordingly to the wheel drum, or more particularly, to that part projecting beyond the outer rail head flank. The upper edge of the side profile can thus be designed such that it is always wide enough for the wheel to run on the side profile if it departs from the rail and for the wear that occurs to be equal to that of the rail. By dispensing with the longitudinal encapsulation of the rails, the previously required operation of milling the joint and casting the encapsulation material is no longer necessary, resulting in time and cost savings. In addition, the inventive solution is less maintenance-intensive.

A "rail" is understood here to be a track rail, for example a grooved rail, a Vignole rail or a crane rail.

Here the term "near to the rail" means oriented in the immediate vicinity of the rail, or oriented towards the rail, while "remote from the rail" means at a distance from the rail, or oriented away from the rail. In relation to a side profile a 'near-to-the-rail region' is, for example, a region that is located directly on or near to the rail, while a 'remote-from-the-rail region' of the side profile is a region that is at a distance from the rail, for example, is arranged at the outer edge of the side profile, or forms the said outer edge.

With reference to the inventive damping arrangement the terms "outside" and "inside" relate to the usual track design with two parallel rails and a track interior located between them. The terms "outside", "outer", etc. thus denote an orientation away from the track interior. The term "outer side profile" therefore refers to a side profile on the outer side of a rail, i.e., the side of the rail facing away from the track interior. The term 'inner side profile' means a side profile arranged on the side oriented towards the track interior. Correspondingly, the term "outer rail head flank" refers to a flank of the rail head pointing away from the track interior, while the term "outer rail head lower face" refers to the lower face of the rail head located on the side of the rail opposite the track interior. The wheel flanges of the flanged wheels of rail vehicles are also regularly oriented towards the track interior.

The term "flanged wheel" is used here to describe a wheel that has a flange projecting from the edge of the wheel disk, beyond the running surface of a wheel. The running surface is also referred to here as the "wheel drum".

A different hardness of profile regions can be achieved by different composition of the elastomeric material in the corresponding regions. However, it is preferable to produce different hardnesses by means of cavities in the elastomeric material. The cavities are preferably filled with gas, for example air, and can be deformed and pressed together during compression, so that elastomeric material is displaced into at least part of the cavities as a result of compression of the side profile. The cavities can, for example, be an oval, or an extended oval, in profile cross-section, and can, for example, be 4 to 6 mm wide and 10 to 20 mm long. The cavities can also be arranged horizontally in two or more rows, in particular in the near-to-the-rail region of the outer rail head lateral flank. The cavities preferably extend in the longitudinal direction of the profile so that they form corresponding longitudinal channels. The term "profile longitudinal direction" refers to the longitudinal direction of the side profile, that is to say, the direction parallel to the course of the rail. The cavities are preferably arranged such that webs of solid profile material are formed through the soft region in the direction transverse to the longitudinal direction of the outer side profile, that is to say, in the direction away from the rail towards the rigid surrounding material. Together with the cavities, the webs effect a dissipation of the forces acting on the rail without subjecting the contact region with the surrounding material to significant compressive stress or movement. The essentially incompressible hard region in the remote-from-the-rail region of the outer rail head lateral flank is preferably designed to be solid, i.e. without cavities, and of an appropriate Shore hardness. The hard region, which preferably directly adjoins the surrounding material, for example the surrounding concrete, and can also be connected to it by suitable measures, e.g. tooth forms, fibres, adhesive bonding etc., preferably has a larger cross-section than the soft region.

The outer side profile preferably has a larger cross-section in the region of the outer rail head lateral flank than in the region of the rail head lower face, i.e. it tapers towards the rail head lower face.

It is preferable for the outer side profile to bear against the outer side of the rail in the region of the outer rail head lateral flank, in the region of the outer rail head lower face, and in the region of the rail web. The side profile should also preferably bear against at least a part of the rail foot. It can also be designed such that it encases the rail foot from above.

In a preferred embodiment of the inventive damping arrangement, the outer side profile in the region of the outer rail head lateral flank has a width W that corresponds at least to the maximum projection X of a wheel drum of a flanged wheel beyond the outer rail head lateral flank. The width W is therefore preferably at least large enough for the projecting part of the wheel drum to run onto the upper edge of the outer side profile in the event that it runs off the rail, and not onto the hard surrounding material, for example, the surrounding concrete or asphalt.

The width W is preferably adjusted by an appropriate widening of the incompressible hard region outwards, i.e. in the direction facing away from the track interior. It is preferable if, in the region of the outer rail head lateral flank, the hard region remote from the rail has a larger extent than the soft region near to the rail.

In the hard region, for example, an open-top recess can be provided, in which, for example, electrical devices, for example signalling devices, for example LEDs, can be arranged. The visible surface of the hard and also, if required, the soft region, can be coloured, for example with a luminescent colour.

The rail can, for example, take the form of a Vignole, crane or grooved rail. In the case of an essentially axisymmetric rail, e.g. a Vignole or crane rail, the damping arrangement can have an inner side profile which is essentially axially symmetrical to the outer side profile. However, this is not essential. On the contrary, a side profile of known prior art can also be arranged on the inner side of such a rail.

In a preferred embodiment of an inventive damping arrangement the rail is designed as a grooved rail. The rail head of such a grooved rail comprises a running rail with a running rail head, and a guide rail with a guide rail head, together with a groove formed between running rail and guide rail. The guide rail, which can be integral with the running rail, or can be designed as a separate element that can be connected to the running rail, is directed towards the track interior. In addition to the outer side profile, this embodiment comprises an inner side profile of elastomeric material, i.e. directed towards the track interior, which bears against the rail, at least in the region at the side of the running rail flank and in the region below the running rail, and wherein the inner side profile has an elastically compliant soft region in the region below the running rail and in the region at the side of the running rail flank. The elastically compliant soft region is preferably a region with cavities in the elastomeric material, wherein the cavities in the region at the side of the guide rail flank are preferably arranged horizontally in two or more rows.

The outer and/or inner side profile preferably consist of a preferably electrically insulating elastomeric material, preferably of styrene-butadiene rubber (SBR), natural rubber (NR), a natural rubber-butyl rubber mixture (NR/BR), or of ethylene-propylene-diene copolymer (EPDM).

It is preferable for the cross-section of the outer and/or inner side profile to reduce towards the rail foot. Both side profiles thus taper in the direction of the rail foot.

It is also preferable for the outer and/or inner side profile not to fill the associated rail chamber completely. The outer and/or inner side profile therefore has a comparatively small cross-section in the region of the associated rail chambers. The outer and/or inner side profile is therefore particularly preferably designed in the form of a strip and can be applied onto the contour of the rail. Here "in the form of a strip" means that the side profile is essentially planar and has a comparatively small thickness. Such a side profile is comparatively easy to produce and the coiling of the profile is also facilitated, preventing deformation and enabling the provision of longer and cheaper lengths. In addition, such a design facilitates the adaptation to the rail contour.

In order to further facilitate the adaptation to the rail contour, in a preferred embodiment of the inventive damping arrangement the outer and/or inner side profile has at least one creasing groove. This can take the form of a notch in the side profile such that the cross-section of the longitudinal profile is reduced, and in this way bending or creasing is facilitated. However, it is also possible to provide a softer material in regions that have to be bent or creased.

The outer and/or inner side profile can consist of several separate parts. It is preferable, however, for the outer and/or inner side profile to be formed in one piece. However, this does not exclude the possibility that the outer and/or inner side profile can have intrinsically different materials, and can be produced, for example, by coextrusion of these different materials.

The outer and/or inner side profile can essentially cover the respective side region, i.e. the outer or inner side of the rail, completely. As a result, the side profile essentially covers the regions of the rail that point in a horizontal direction. In this preferred case, the outer and/or inner side profile bears against the rail in such a way that the lateral surfaces of the latter are essentially completely covered. In this way, the lateral surfaces of the rail can be insulated against moisture etc.

The outer and/or inner side profile can be anchored in the surrounding material, e.g. concrete or asphalt, in particular in the vicinity of the rail head and/or the guide rail, i.e. in the region at the side of and below the rail head or guide rail, by way of fibres that are fixedly connected to the side profile and project beyond the side profile surface. The fibres can be embedded directly into the profile material, or can be embedded in an adhesive layer arranged on the profile surface. The fibres can, for example, be connected to the profile by means of electrostatic flocking. The fibres can, for example, consist of metal, glass, cotton or plastic, for example a polyamide, polyester or aramid. The fibres preferably have essentially the same length. Suitable fibre lengths can easily be determined by the person skilled in the art. For example, the fibre length can be 0.5-12 mm, preferably 1-10, 1-7, 1-5, 1-4 or 1-3 mm. The number, type, cross-section, length and penetration depth of the fibres can be selected and/or adapted by the person skilled in the art, depending on the purpose in question, and taking into account the forces to be anticipated or to be absorbed. The connection between the outer and/or inner side profile and the surrounding material by means of fibres need not be such that each of the fibres is anchored at one end to the outer and/or inner side profile and at the other end to the surrounding material. It is also possible that fibres connected to the outer or inner side profile and fibres connected to the surrounding material are indirectly connected via other fibres in the manner of a fleece, so that a fibrous fleece is arranged between the side profile and the surroundings.

The upper surface of the outer side profile running transversely to the rail web is preferably essentially aligned with the rail head surface. The upper surface is therefore essentially located in the plane of the rail head surface that is to be travelled on by the wheel drum of a flanged wheel. Here the expression that the upper surface of the outer side profile is "essentially in the plane of the rail head surface" can also mean that the upper surface is just below or just above the rail head surface. The upper surface of the outer side profile is particularly preferably located essentially both in the plane of the rail head surface in the case of a grooved rail, in the plane of the surface of the running rail head) and essentially also in the plane of the surface of the surrounding material. The same preferably applies to the inner side profile.

Reinforcements such as steel plates, perforated plates, etc. can also be provided to support and/or enclose the profile, particularly in the region of the rail head and/or running rail.

In a second aspect, the invention also relates to an outer side profile of elastomeric material for a rail relating to tracks to be travelled on by rail vehicles with flanged wheels, wherein the rail has: i) a rail head having an outer rail head lateral flank and an outer rail head lower face, ii) a rail web, iii) a rail foot, and iv) an outer side facing away from the track interior, and wherein the outer side profile is accordingly designed to be applied to the outer side of the rail, at least in the region of the outer rail head lateral flank, and in the region of the outer rail head lower face, and wherein the outer side profile has, in the region to be applied to the outer rail head lower face and the outer rail head lateral flank, an elastically compliant soft region located near to the rail against the rail head, and, in the region to be applied to the outer rail head lateral flank, an essentially incompressible hard region remote from the rail.

The outer side profile of the invention is accordingly adapted and designed to be used advantageously as an outer side profile in a damping arrangement in accordance with the first aspect of the invention.

In the outer side profile of the invention, the soft region and the hard region preferably consist of the same elastomeric material, wherein the soft region has cavities in the elastomeric material, while the elastomeric material of the hard region is designed to be solid.

In the case of the outer side profile of the invention, the cavities of the soft region, which comes to lie in the region of the outer rail head lateral flank, are preferably arranged in at least two rows in the horizontal direction.

In a preferred embodiment, the cavities of the soft region are arranged in such a way that webs of solid profile material remain, running through the soft region in the direction transverse to the longitudinal direction of the outer side profile.

The hard region, which comes to lie in the region of the outer rail head lateral flank preferably has an extent z that is greater than the extent y of the soft region which comes to lie in the region of the outer rail head lateral flank.

It is also preferable that:

a. the outer side profile consists of a preferably electrically insulating elastomeric material, preferably of styrene-butadiene rubber (SBR), natural rubber (NR), a natural rubber-butyl rubber mixture (NR/BR) or of ethylene-propylene-diene copolymer (EPDM), and/or b. the cross-section of the outer side profile reduces towards the end located on the rail foot; and/or c. the outer side profile is designed such that it does not completely fill the rail chamber in which the outer side profile is to be arranged, and/or d. the outer side profile is designed in the form of a strip and can be applied onto the contour of the rail, and;

e. the outer side profile is formed in one piece, and/or f. the outer side profile has at least one creasing groove, and/or g. the outer side profile essentially covers the outer side of the rail completely, and/or h. the outer side profile has in its hard region an open-top recess for the accommodation of electrical devices, and/or i. the outer side profile has tooth forms and/or fibres, at least in the region of the outer rail head lateral flank and in the region of the outer rail head lower face remote from the rail, by way of which the outer side profile can be connected in a force fit to a rigid surrounding material.

The formulation, in accordance with which the side profile can be connected in a force fit to a rigid surrounding material, refers to the fact that the tooth forms or fibres can be embedded in a material that is initially free flowing, and then hardens into a rigid material, e.g. concrete.

In what follows the invention is explained in more detail for purely illustrative purposes, with the aid of the attached figures relating to preferred embodiments of the invention.

Figure 1:
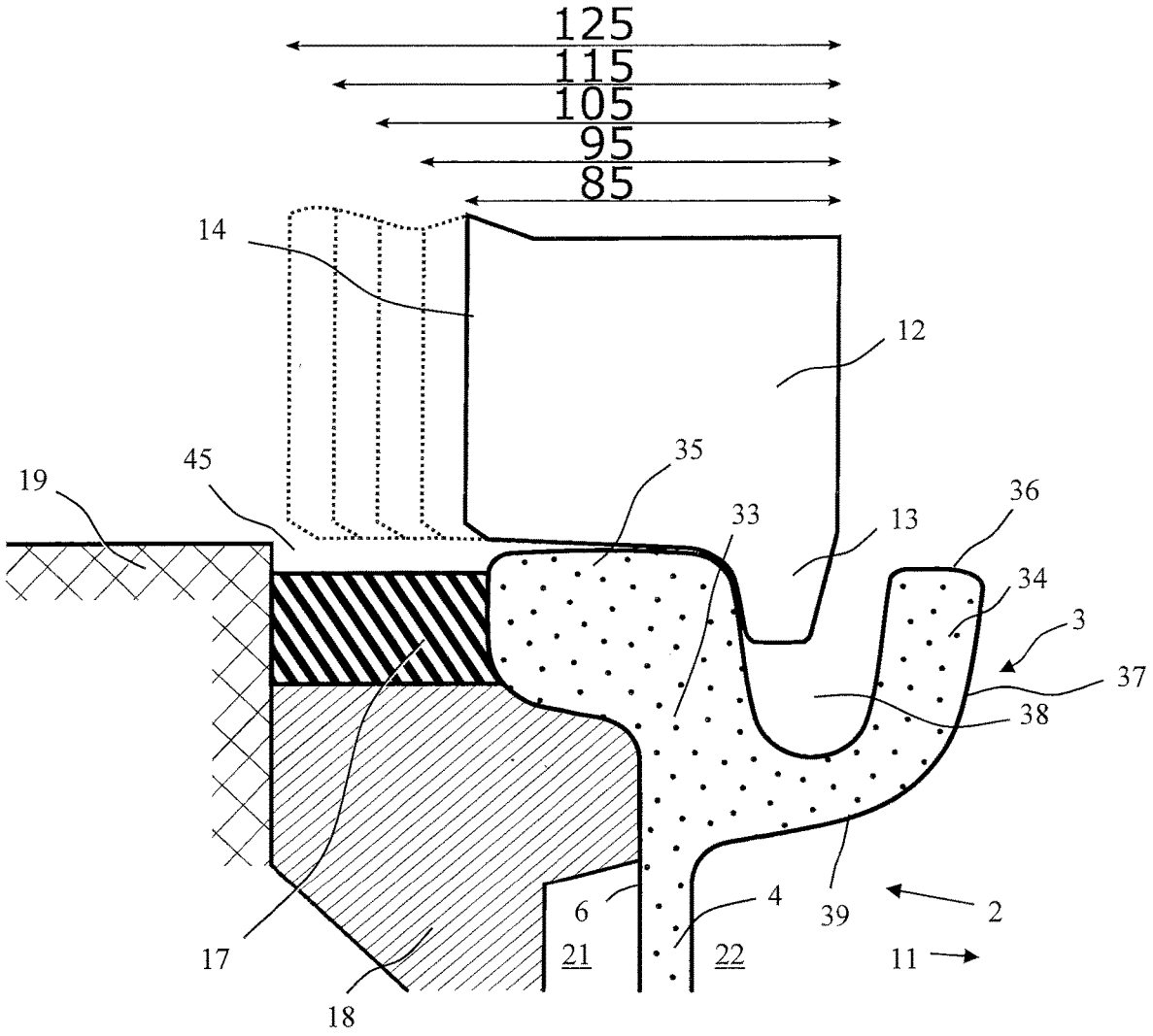
Fig. 1 (prior art)
FIG. 1 shows a damping arrangement in accordance with the prior art.

FIG. 1 shows a cross-sectional view of a part of a generic damping arrangement as known from the prior art. The figure shows the upper part of a rail 2 with a rail head 3, which here is designed as a grooved rail. A groove 38 is rolled into the rail head 3 so as to accommodate the flange 13 of a flanged wheel 12, for example a tram wheel. In this way, a running rail 33 and a guide rail 34 are formed, with the groove 38 located between them. The rail 2 is embedded in a rigid surrounding material 19, such as concrete or asphalt. The running rail 33 has a running rail head 35, the guide rail 34 has a guide rail head 36, a lateral guide rail flank 37 and a guide rail lower face 39. An outer side profile 18 essentially filling the outer rail chamber 21 is arranged on the outer side 6 of the rail 2, i.e. on the side of the rail 2 facing away from the track interior 11. A longitudinal rail encapsulation 17 of a suitable cast material has been introduced into a joint 45 milled into the rigid surrounding material 19. The figure also shows a part of a flanged wheel 12 located on the running rail 33 with a flanged wheel 13 and a wheel drum 14. The figure schematically shows various possible widths (in millimetres) of the wheel drum 14 of the prior art in the state of the art. The longitudinal rail encapsulation 17 serves, amongst other functions, as an expansion joint, and also serves to prevent the wheel drum 14 from running on the rigid surrounding material 19 in the event of increasing wear of the running rail 33. The width of the longitudinal rail encapsulation 17 is adapted to the width of the wheel drum 14 accordingly.

Figure 2:
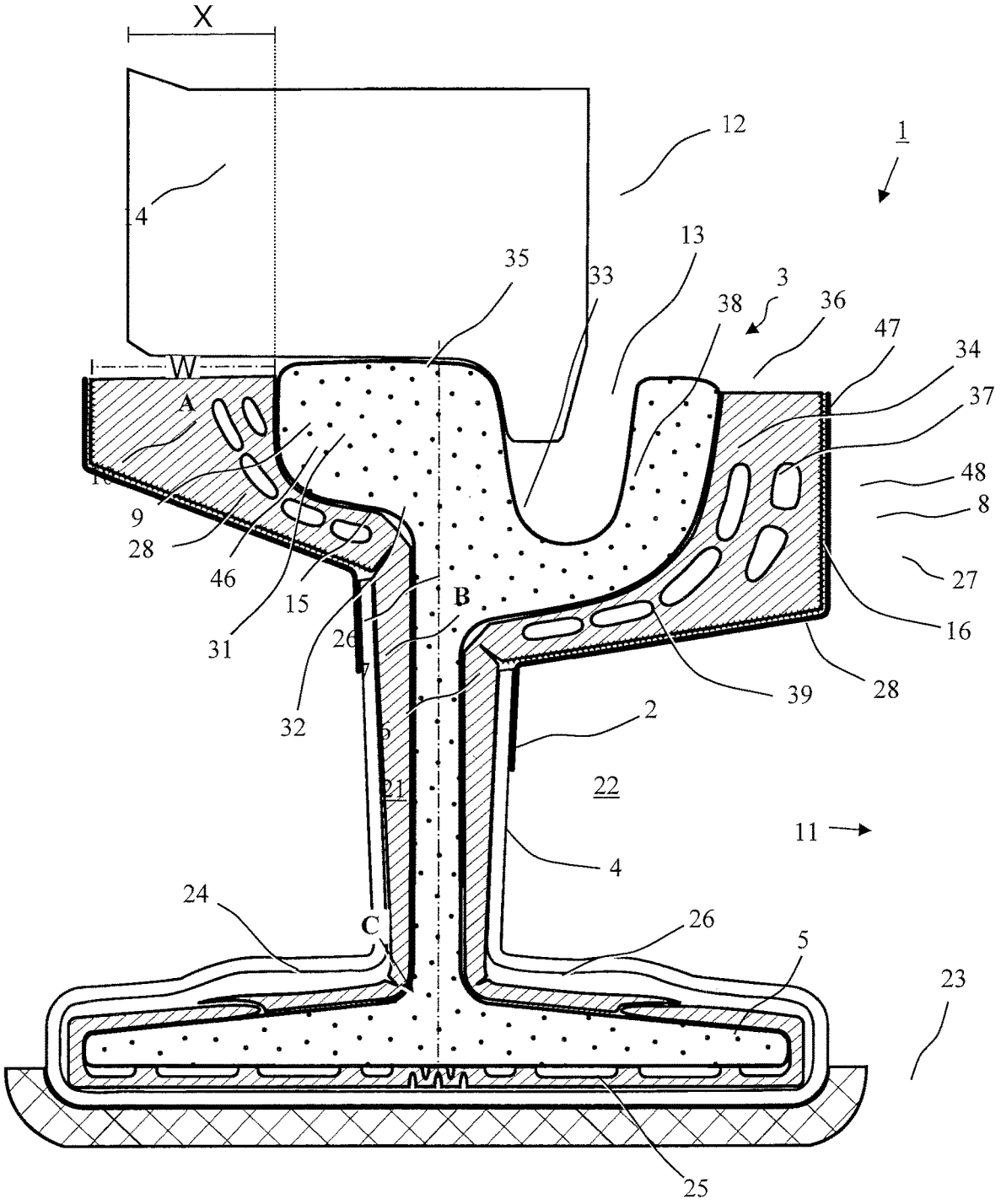
FIG. 2 shows a sectional view of an embodiment of an inventive damping arrangement.

FIG. 2 shows a cross-sectional view of an embodiment of an inventive damping arrangement 1. A rail 2 designed as a grooved rail is also shown here. On the outer side 6 of the rail, i.e. on the side of the rail 2 facing away from the track interior 11, an outer side profile 7 of elastomeric material is provided, which is in the form of a strip that does not completely fill the outer rail chamber 21. In this embodiment, the outer side profile 7 essentially has three sections A, B, C, which are separated here by creasing grooves 26. Section A of the outer side profile 7 is located in the region of the outer rail head lateral flank 31, and the outer rail head lower face 32, while section B is located in the region of the rail web 4, and section C is located on a part of the upper side of the rail foot 5 on the outer side 6 of the rail. A foot profile 25 made of elastomeric material, which surrounds the rail foot 5 from below, engages with the end of the outer side profile 7. The cross-section of the outer side profile 7 tapers in the direction of the rail foot 5. The outer side profile 7 is geometrically adapted to the shape of the rail 2 at the contact surface with the rail. The creasing grooves 26 ensure that the outer side profile 7 can be more easily applied onto the outer shape of the rail 2. In the region of the rail head 3, the cross-section of the outer side profile 7 widens. In the region of the rail head lower face 32 and the outer rail head lateral flank 31, the outer side profile 7 has a soft region 9 near to the rail that is elastically compliant against the rail head 3. Here the soft region 9 is produced, for example, by longitudinal oval cavities 15 in the cross-section of the elastomeric material of the outer side profile 7. The cavities 15 extend in the longitudinal direction of the outer side profile 7, i.e. in the direction perpendicular to the plane of the paper, and thus form longitudinal channels running parallel to the rail 2 in the outer side profile 7. In the example shown here of an inventive damping arrangement 1, the cavities 15 in the upper part of the soft region 9 are arranged in two rows in the horizontal direction. The cavities 15 located at the side of and below the rail head 3 have, for example, a width of 4-6 mm and a length of 10-20 mm. The cavities 15 are arranged such that continuous webs 46 of solid profile material are formed in the longitudinal direction of the outer side profile 7; these extend through the soft region 9 in the direction transverse to the longitudinal direction of the outer side profile 7 (see also FIG. 3). The webs 46 and the cavities 15 enable the horizontal and vertical movement of the rail 2 to be intercepted/dissipated without essentially compressing or moving the contact region relative to the surrounding material 19, not shown in this figure. Likewise, the horizontal multi-row arrangement of cavities 15, in particular in the region of the outer rail head lateral flank 31, intercepts the vertical movement in the direction of the outer edge of the outer side profile 7.

In the region of the outer rail head lateral flank 31, a hard region 10 is provided in the outer side profile 7 remote from the rail, i.e. in the part of the outer side profile 7 located further from the rail 2. In the hard region 10, which in use forms the connecting region to the rigid surrounding material 19, the outer side profile 7 has a solid incompressible material cross-section. The dimensions of the hard region 10 can be, for example, at least 20×30 mm. This supports the connecting region, especially in the upper region, and prevents fractures and cracks. The arrangement of the cavities 15 ensures that the outer side profile 7 is very soft towards the rail 2, and very hard towards the rigid surrounding material 19.

The width W of the outer side profile 7 in the vicinity of the outer rail head lateral flank 31 is at least equal to the width X of that part of the wheel drum 14 that projects beyond the outer rail head lateral flank 31. The width W is preferably at least slightly larger than the width X in order to prevent the wheel drum 14 of the flanged wheel 12 from running on the rigid surrounding material 19 in the event of increasing wear of the running rail head 35.

The outer side profile 7 takes over entirely the task that the longitudinal rail encapsulation 17 has in the prior art, so that such longitudinal rail encapsulation 17 can be completely dispensed with.

The outer side profile 7 with its upper surface 51 running transversely to the rail web 4 lies essentially in the plane of the rail head surface 50 to be travelled on by the wheel drum 14 of a flanged wheel 12, here the surface of the running rail head 35 of a grooved rail. The upper surface 51 also lies essentially in the plane of the surface of the surrounding material 19.

In the embodiment of an inventive damping arrangement 1 shown here, an inner side profile 8 of elastomeric material is provided in the inner rail chamber 22, that is to say, in the rail chamber facing towards the track interior 11. The inner side profile 8 is also subdivided into three sections A, B, C, and is designed in the form of a strip adapted to the contour of the rail 2. Here, too, there are creasing grooves 26 so as to make it easier to adapt the inner side profile 8 to the contour of the rail 2. The inner side profile 8 also has a section that widens in cross-section towards the rail head 3. The inner side profile 8 is located on the rail 2 in the region to the side of the guide rail flank 37, in the region below the guide rail 34, in the region of the rail web 4, and on a part of the rail foot 5. The inner side profile 8 also engages with the foot profile 25. The inner side profile 8 has an elastically compliant soft region 16 in the elastomeric material in the region below the guide rail 34, that is to say, in the region below the guide rail lower face 39, and in the region to the side of the outer guide rail flank 37. Here too the soft region 16 here is implemented by means of cavities 48 in the profile material. Towards the upper end of the inner side profile 8 there is a hard region 47 above the soft region 16; here this is a solidly formed, essentially incompressible region of the inner side profile 8. Here too the cavities 48 of the soft region 16 located in the region of the guide rail flank 37 are arranged in two rows in the horizontal direction. The upper surface of the inner side profile 8 is essentially located in the plane of the upper surface of the guide rail head 36 and the surface of the adjacent surrounding material 19.

In the contact region with the rigid surrounding material 19, the outer side profile 7 and the inner side profile 8 3 here have tooth forms 28 in the region of the rail head so as to establish a force-fit connection with the rigid surrounding material 19. The tooth forms 28 take the form of saw-tooth profiles of the profile surface. The embodiment shown here is provided with a welded joint collar 24 enveloping the foot profile 25 and the side profiles 7, 8 in the region of the rail web 4. A rubber film 27 covers the profile joint in the region of the welded joint collar 24 and serves to prevent the penetration of water. In addition, the damping arrangement 1 is arranged on undergrouting 23.

Figure 3:
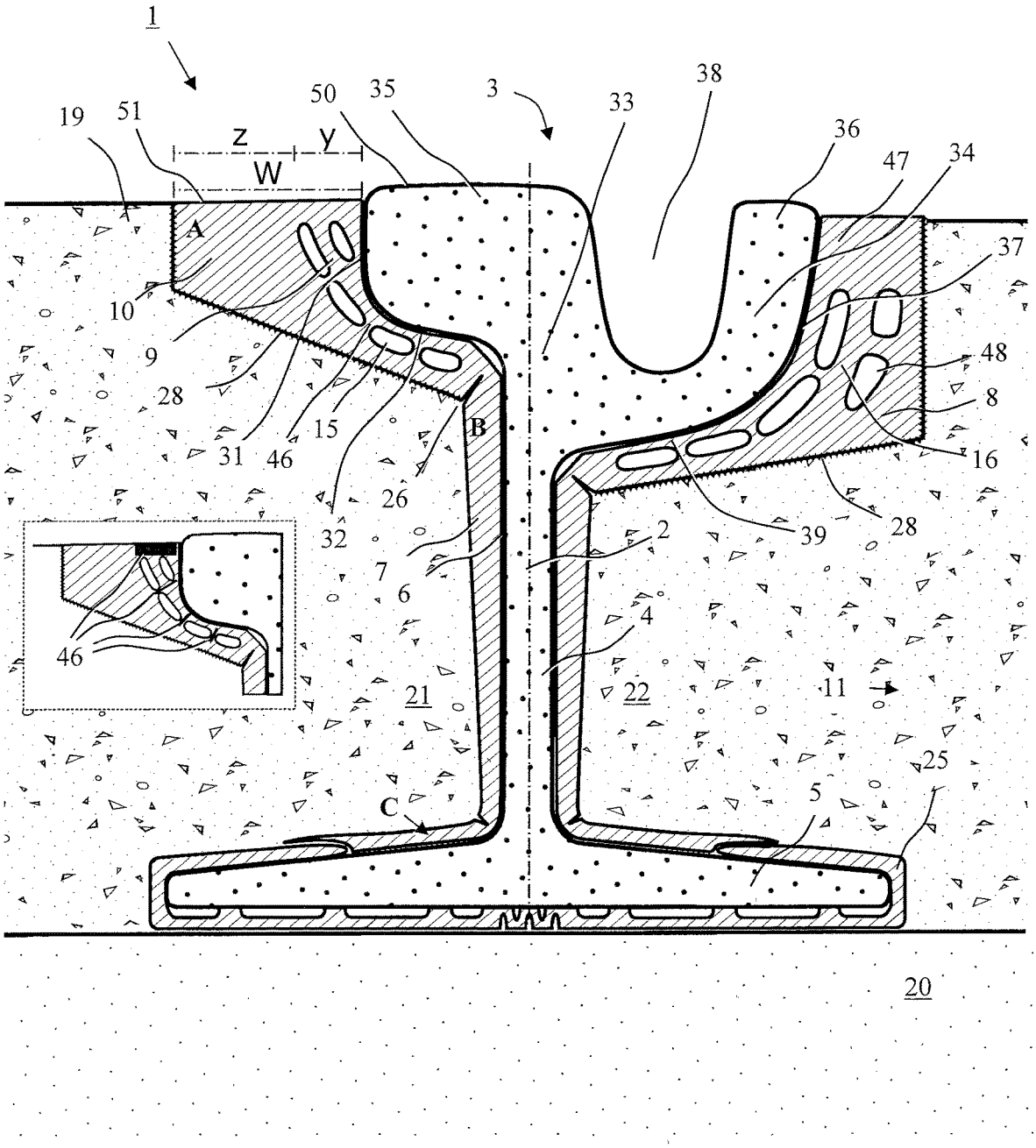
FIGS. 3 to 7 show sectional views of further embodiments of an inventive damping arrangement.
Figure 4:
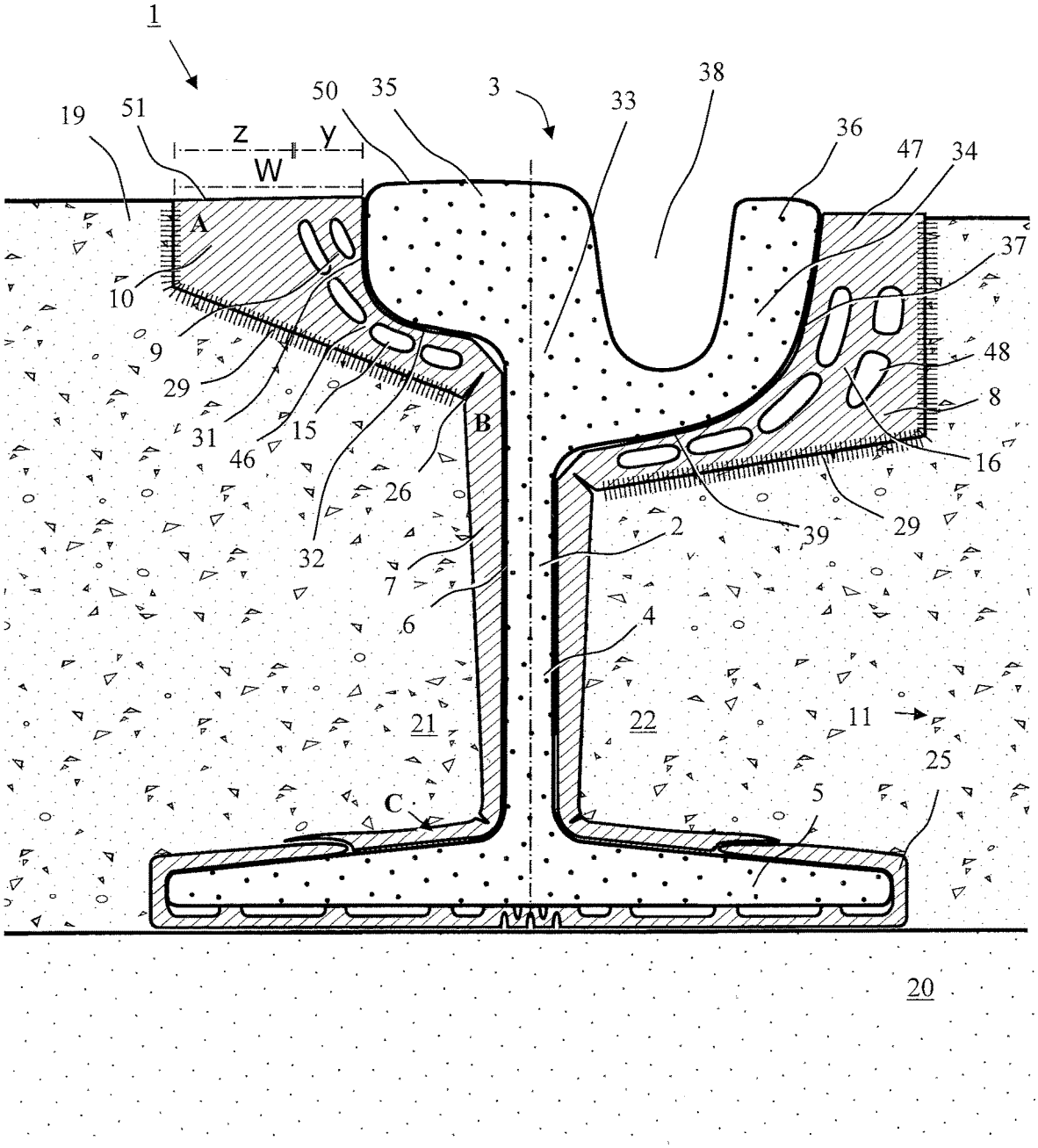

FIG. 3 shows a cross-sectional view of an embodiment of the inventive damping arrangement 1 similar to that shown in FIG. 2, embedded in a rigid surrounding material 19, e.g. a concrete or asphalt pavement, which in turn is arranged on a concrete foundation 20. Here it is schematically indicated that the hard region 10 of the outer side profile 7 has an extent z that is greater than the extent y of the soft region 9. In addition, a detail on the left of the drawing, for illustrative purposes only, highlights solid profile regions that form webs 46.

FIGS. 4 to 7 show further embodiments of an inventive damping arrangement 1, in which various modifications are shown with regard to the configuration of the profiles 7, 8, in particular the section A, for purposes of connection to the rigid surrounding material 19. In the embodiment shown in FIG. 4, for example, fibres 29 are provided instead of tooth forms 28; here these are embedded in the region of the rail head 3 by means of electrostatic flocking, with one end in the surface of the side profiles 7, 8, and with the other end in the rigid surrounding material 19. Needless to say, the embedding takes place during the casting of the rigid surrounding material 19, which can consist of concrete or asphalt, for example.

Figure 5:
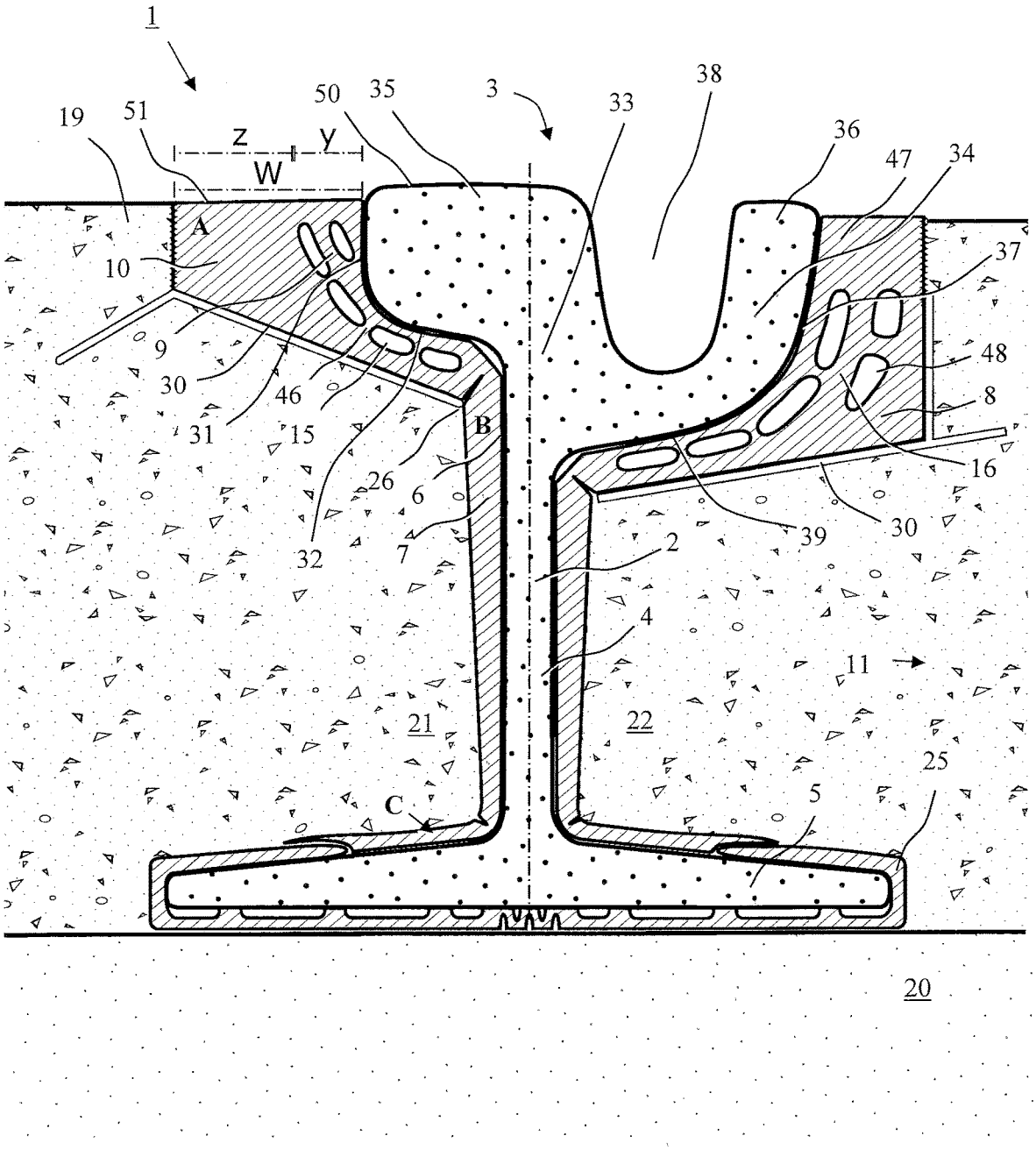

In FIG. 5, steel sheets 30 are arranged to support the head region A of the side profiles 7, 8.

Figure 6:
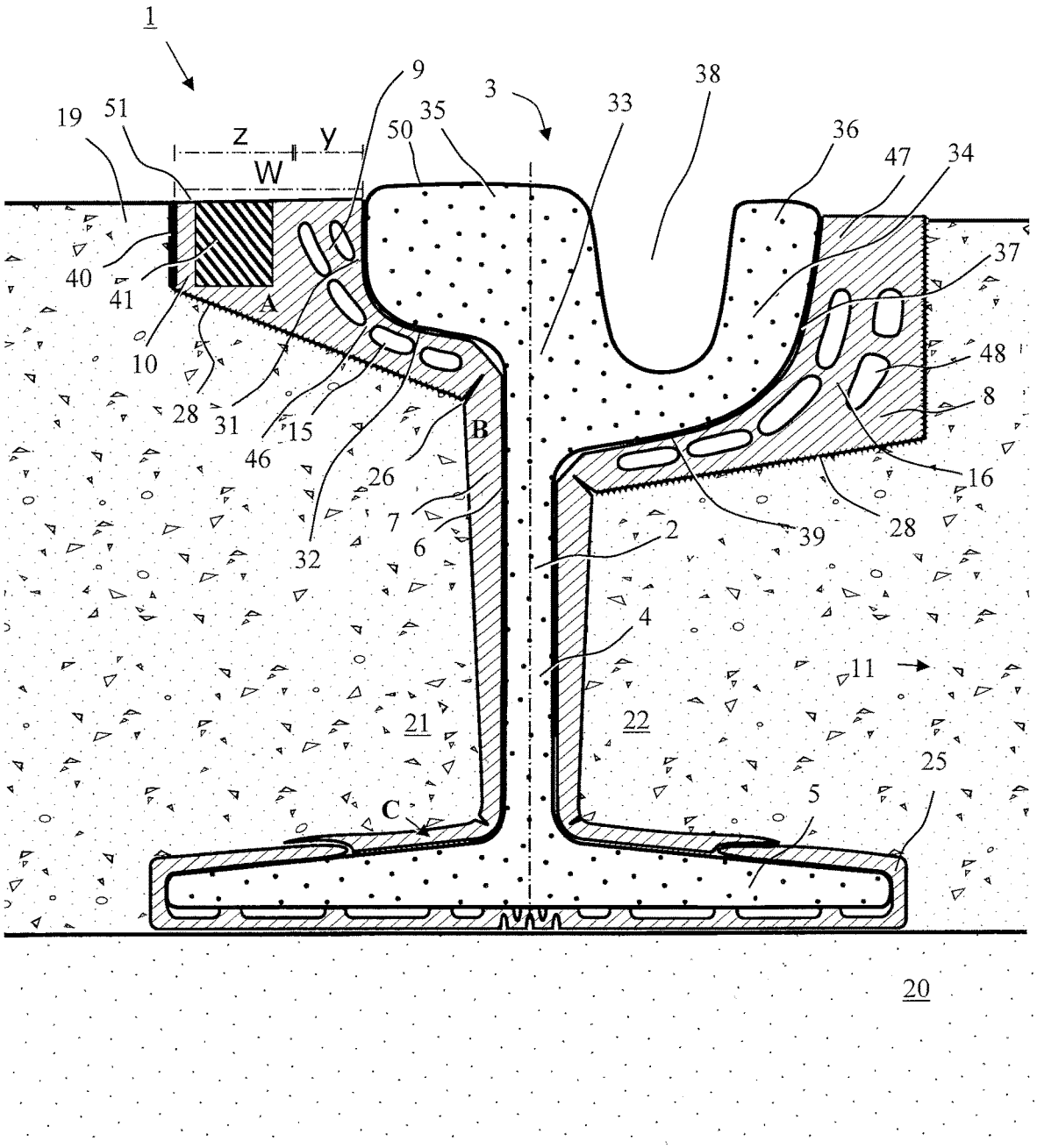
Figure 7:
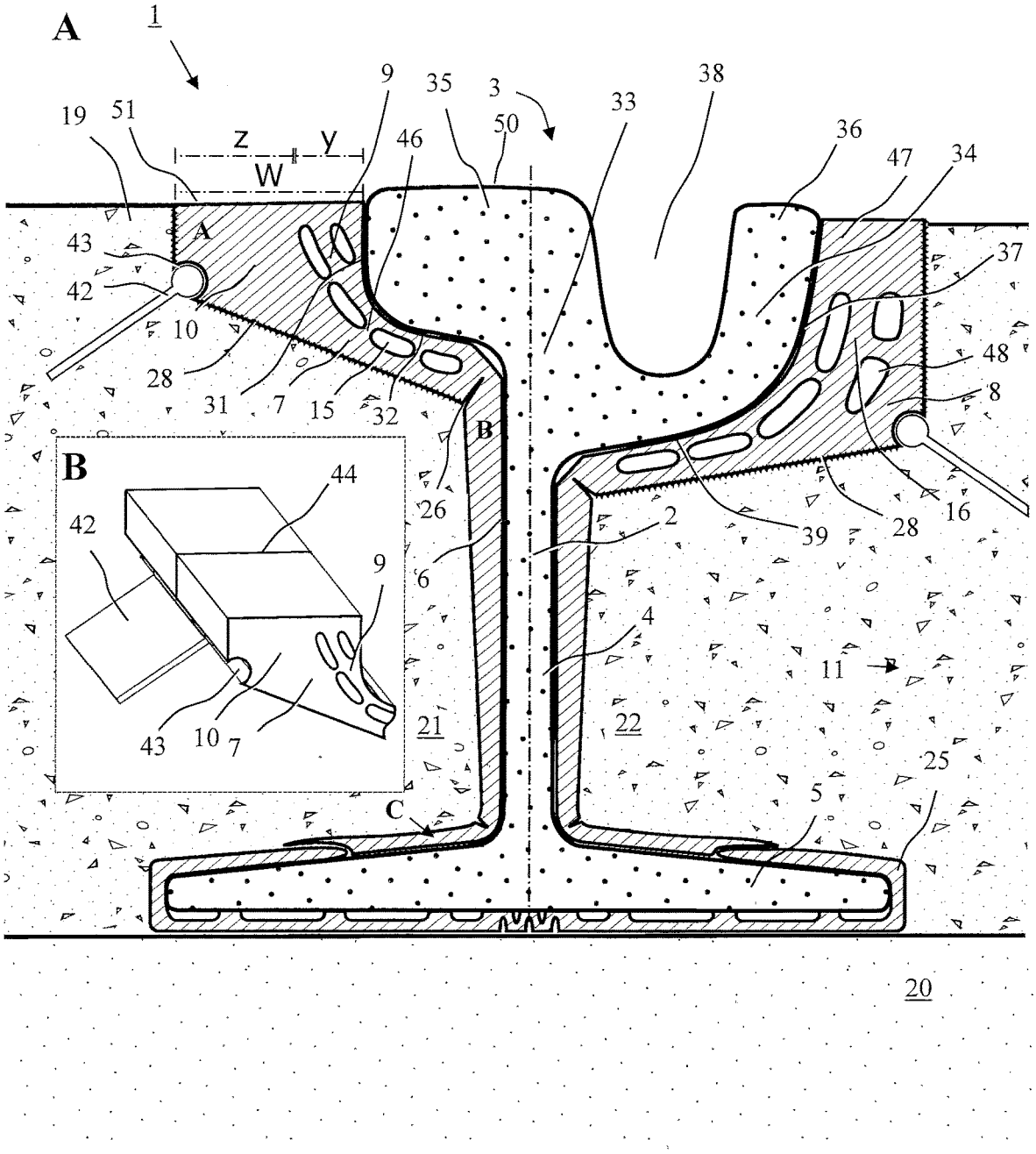

FIG. 6 shows an embodiment in which a recess 41 is provided in the hard region 10 of the outer side profile 7, in which, for example, electrical elements, e.g. LEDs, or the like, can be accommodated. The recess 41 can be configured continuously in the longitudinal direction of the outer side profile 7, and form an open-top channel, or it can also be of a discontinuous design. Here a self-adhesive bitumen joint tape 40 is arranged in the lateral contact region with the surrounding material 19.

FIG. 7A shows a cross-sectional view of an embodiment in which a groove 43 is formed at the edge of the hard region 10, in which a steel plate 42, with an edge region that matches the shape of the groove 43, and which is embedded in the surrounding material 19, is inserted to support the side profiles 7, 8 in the head region. This is particularly advantageous in abutting regions, that is to say, in regions where the strip-form side profiles 7, 8 abut against each other to form joints 44 (see the simplified spatial view shown in FIG. 7B).

The invention claimed is:

1. A damping arrangement for tracks to be travelled on by rail vehicles with flanged wheels, comprising a. a rail, with
   i. a rail head having an outer rail head lateral flank and an outer rail head lower face,
   ii. a rail web,
   iii. a rail foot, and
   iv. with an outer side facing away from the track interior, and b. an outer side profile of elastomeric material, the outer side profile having a section A that bears against the outer side of the rail along the outer rail head lateral flank, and along of the outer rail head lower face, and a section B that bears against the outer wall of the rail along the rail web, wherein the outer side profile has, in section A but not section B, near to the rail, a first section being elastically compliant against the rail head with cavities in the elastomeric material extending in a longitudinal direction of the outer side profile and forming longitudinal channels running parallel to the rail, and has, in the part of section A of the profile bearing against the outer side of the rail along the outer rail head lateral flank, remote from the rail, a solid region, and wherein the elastically compliant first region and the solid second region consist of the same elastomeric material.

2. The damping arrangement in accordance with claim 1, wherein the part of section A of the outer side profile profile bearing against the outer side of the rail along the outer rail head lateral flank has a larger cross-section than the part of section A of the outer side profile bearing against the outer side of the rail along the rail head lower face.

3. The damping arrangement in accordance with claim 1, wherein the part of section A of the outer side profile bearing against the outer side of the rail along the outer rail head lateral flank has a width W that corresponds at least to the maximum projection X of a wheel drum of a flanged wheel beyond the outer rail head lateral flank.

4. The damping arrangement in accordance with claim 1, wherein the cavities of the elastically compliant first region in the part of section A of the outer side profile bearing against the outer side of the rail along the outer rail head lateral flank are arranged in at least two rows in the horizontal direction.

5. The damping arrangement in accordance with claim 1, wherein the cavities are arranged such that webs extending through the elastically compliant first region in the direction transverse to the longitudinal direction of the outer side profile are formed from solid profile material.

6. The damping arrangement in accordance with claim 1, wherein the solid second region has an extent z that is greater than the extent y of the elastically compliant first region.

7. The damping arrangement in accordance with claim 1, with a rail designed as a grooved rail, wherein the rail head comprises a running rail with a running rail head, and a guide rail with a guide rail head and a guide rail flank pointing towards the track interior, together with a groove formed between the running rail and the guide rail, and wherein the damping arrangement further comprises an inner side profile of elastomeric material the inner side profile having a section A that bears against the inner side of the rail at least along the side of the running rail flank, and below the running rail, and a section B that bears against the inner side of the rail along the rail web, and wherein the inner side of the profile has, in its section A, but not in its section B, an elastically compliant region with caveties in the elastomeric material.

8. The damping arrangement in accordance with claim 7, wherein the cavities are arranged horizontally in two or more rows in the region at the side of the guide rail flank.

9. The damping arrangement in accordance with claim 1, wherein a. the outer and/or inner side profile consists of styrene-butadiene rubber (SBR), natural rubber (NR), a natural rubber-butyl rubber mixture (NR/BR), or of ethylene-propylene-diene copolymer (EPDM), and/or b. the cross-section of the outer and/or inner side profile reduces towards the rail foot, and/or c. the outer and/or inner side profile does not completely fill the respectively associated rail chamber, and/or d. the outer and/or inner side profile is in the form of a strip and can be applied onto the contour of the rail, and/or e. the outer and/or inner side profile is formed in one piece, and/or f. the outer and/or inner side profile has at least one creasing groove, and/or g. the outer and/or inner side profile essentially covers the side region of the rail completely, and/or h. the outer side profile has in its hard region an open-top recess for the accommodation of preferably electrical devices, and/or i. the outer and/or inner side profile, at least in the vicinity of the rail head, has tooth forms and/or fibres remote from the rail, via which tooth forms and/or fibres the outer and/or inner side profile can be connected in a force fit to a rigid surrounding material surrounding the damping arrangement j. the outer side profile with its upper surface extending transversely to the rail web lies essentially in the plane of the rail head surface to be travelled on by a wheel drum of a flanged wheel.

10. An outer side profile made of elastomeric material for a rail relating to tracks to be travelled on by rail vehicles with flanged wheels, wherein the rail has: i) a rail head having an outer rail head lateral flank and an outer rail head lower face, ii) a rail web, iii) a rail foot, and iv) an outer side facing away from the track interior, and wherein the outer side profile has a section A adapted to be applied to the outer side of the rail, along the outer rail head lateral flank, and along the outer rail head lower face, and a section B being adapted to be applied to the outer side of the rail along the rail web, and wherein the outer side profile has, in its section A, but not in its section B, a first region being elastically compliant against the rail head with cavities in the elastomeric material extending in a longitudinal direction of the outer side profile and forming longitudinal channels running parallel to the rail, the elastically compliant first region being located near to the rail when applied to the outer side of the rail, and has, in the part of its section A, and has in the part of section A to be applied to the outer rail head lateral flank, a solid second region located remote from the rail, and wherein the elastically compliant first region and the solid second region consist of the same elastomeric material.

11. The outer side profile in accordance with claim 10, wherein the solid second region has an extent z that is greater than the extent y of the elastically compliant first region in the part of section A of the profile applied to the outer rail head lateral flank.

12. The outer side profile in accordance with claim 10, wherein the cavities of the elastically compliant first region in the part of section A of the outer side profile to be applied against the outer side of the rail along the outer rail head lateral flank, are arranged in at least two rows in the horizontal direction, and/or the cavities of the elastically compliant first region are arranged in such a way that webs, running through the elastically compliant first region in the direction transverse to the longitudinal direction of the outer side profile, are formed from solid profile material.

13. The outer side profile in accordance with claim 10, wherein a. the outer side profile consists of styrene-butadiene rubber (SBR), natural rubber (NR), a natural rubber-butyl rubber mixture (NR/BR) or of ethylene-propylene-diene copolymer (EPDM), and/or b. the cross-section of the outer side profile reduces towards the end located on the rail foot, and/or c. the outer side profile does not completely fill the rail chamber in which the side profile is to be arranged; and/or d. the outer side profile is in the form of a strip and can be applied onto the contour of the rail, and/or e. the outer side profile is formed in one piece, and/or f. the outer side profile has at least one creasing groove, and/or g. the outer side profile essentially covers the outer side of the rail completely, and/or h. the outer side profile has in its hard region an open-top recess, for the accommodation of electrical devices, and/or i. the outer side profile has tooth forms and/or fibres remote from the rail, at least in the vicinity of the outer rail head lateral flank and in the vicinity of the outer rail head lower face, by way of which the outer side profile can be connected in a force fit to a rigid surrounding material.

* * * * *